US011281129B2

(12) United States Patent
House et al.

(10) Patent No.: US 11,281,129 B2
(45) Date of Patent: Mar. 22, 2022

(54) NIP ADJUSTMENT

(71) Applicant: HEWLETT-PACKARD DEVELOPMENT COMPANY, L.P., Spring, TX (US)

(72) Inventors: Hagai House, Ness Ziona (IL); Ido Finkelman, Ness Ziona (IL); Rivay Mor, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,920

(22) PCT Filed: Jul. 17, 2018

(86) PCT No.: PCT/US2018/042461
§ 371 (c)(1),
(2) Date: Oct. 17, 2019

(87) PCT Pub. No.: WO2020/018077
PCT Pub. Date: Jan. 23, 2020

(65) Prior Publication Data

US 2021/0333727 A1 Oct. 28, 2021

(51) Int. Cl.

| | |
|---|---|
| ***G03G 15/16*** | (2006.01) |
| ***G03G 21/16*** | (2006.01) |
| ***G03G 15/01*** | (2006.01) |
| ***G03G 15/00*** | (2006.01) |

(52) U.S. Cl.
CPC ..... *G03G 15/167* (2013.01); *G03G 15/0131* (2013.01); *G03G 15/0136* (2013.01); *G03G 15/165* (2013.01); *G03G 15/1655* (2013.01); *G03G 15/1665* (2013.01); *G03G 15/5054* (2013.01); *G03G 21/168* (2013.01); *G03G 2215/1614* (2013.01)

(58) Field of Classification Search
CPC ..... G03G 15/0131; G03G 15/0136; G03G 15/165; G03G 15/1655; G03G 15/1665; G03G 15/167; G03G 15/5054; G03G 21/168; G03G 2215/1614
See application file for complete search history.

(56) References Cited

U.S. PATENT DOCUMENTS

| | | | |
|---|---|---|---|
| 5,163,368 | A | 11/1992 | Pensavecchia et al. |
| 6,530,321 | B2 | 3/2003 | Andrew et al. |
| 8,438,976 | B2 | 5/2013 | Levanon et al. |
| 9,884,479 | B2 | 2/2018 | Landa et al. |
| 2002/0075375 | A1 | 6/2002 | Yamakawa et al. |
| 2003/0234847 | A1 | 12/2003 | Takekoshi et al. |
| 2004/0165927 | A1 | 8/2004 | Fisher et al. |

(Continued)

FOREIGN PATENT DOCUMENTS

| | | | |
|---|---|---|---|
| DE | 4332498 | A1 | 3/1995 |
| WO | WO2017186300 | A1 | 11/2017 |

*Primary Examiner* — Joseph S Wong
(74) *Attorney, Agent, or Firm* — Dierker & Kavanaugh PC

(57) ABSTRACT

In one example, a device comprises an image transfer member, a platen to form a first nip with the image transfer member, a photo imaging plate to form a second nip with the image transfer member, and a controller to determine first information relating to a characteristic of the first nip, and to determine second information for use in adjusting a relative position of the photo imaging plate and the image transfer member on the basis of the first information.

15 Claims, 6 Drawing Sheets

(56) References Cited

U.S. PATENT DOCUMENTS

| | | | | |
|---|---|---|---|---|
| 2006/0185541 | A1 | 8/2006 | Czeranka et al. | |
| 2009/0116893 | A1 | 5/2009 | Furuki et al. | |
| 2009/0279918 | A1* | 11/2009 | Sendo | G03G 15/167 399/121 |
| 2010/0303495 | A1* | 12/2010 | Kurosu | G03G 15/2064 399/68 |
| 2017/0160677 | A1 | 6/2017 | Portnoy et al. | |
| 2019/0354041 | A1* | 11/2019 | Murakami | G03G 15/1615 |

* cited by examiner

NIP ADJUSTMENT

BACKGROUND

In some printers, sometimes referred to as a press, a developed image is transferred from a surface of one member to a surface of another member before the developed image is deposited on a print media. Pressure between the members establishes transfer of the developed image. In one example, a developed image is transferred between a photo imaging plate (PIP) and a blanket of an image transfer member. Subsequent transfer takes place from the blanket to a desired print media, which is placed into contact with the blanket and pressed against the blanket by a platen, such as an impression drum. The contact regions between the PIP and the blanket and between the blanket and the platen are sometimes referred to as nips.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
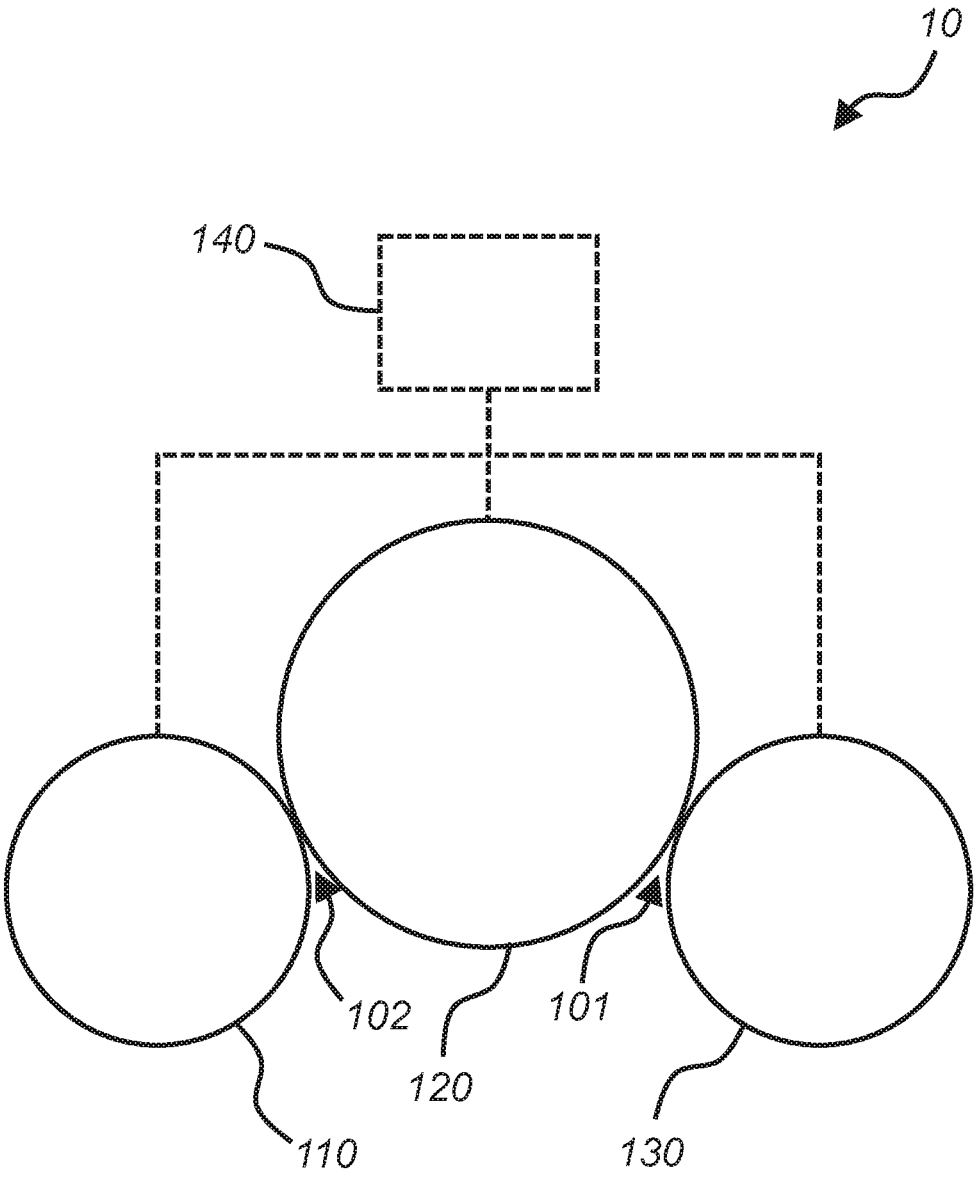
FIG. 1 is a schematic view of a printing device in accordance with an example.

In the following description, for purposes of explanation, numerous specific details of certain examples are set forth. Reference in the specification to "an example" or similar language means that a particular feature, structure, or characteristic described in connection with the example is included in that one example, but not necessarily in other examples.

In some printers, a transfer element, such as an image transfer member, is used to transfer developed liquid toner to print media. For example, a developed image, comprising liquid toner aligned according to a latent image, may be transferred from an imaging element, such as a photo imaging plate (PIP), to a blanket of an image transfer member. This is sometimes referred to as the "first transfer". Subsequent transfer may take place from the blanket to a desired print media, which is placed into contact with the blanket and pressed against the blanket by a platen, such as an impression drum. This is sometimes referred to as the "second transfer". The contact regions between the PIP and the blanket and between the blanket and the platen are sometimes referred to as respective nips. The image transfer member is sometimes referred to as an intermediate transfer member, due to the interaction with both the PIP and the platen.

The first and second transfer take place under pressure to ensure a good print quality because printing fluid is transferred in the process. The pressure at the nips is achieved by an engagement force between the PIP and the blanket for the first transfer and between the blanket and the platen for the second transfer. The pressure at the second transfer may be much higher than at the first transfer and may for example be 10 times higher. The risk of mechanical damage and risk to safety is greater at the second transfer due to the higher pressure. Consequently, a change of displacement between contacting members at the high-pressure nip will have a greater impact on print quality than the same change of displacement at the low-pressure nip. Therefore, one or more characteristics at the high-pressure nip between the blanket and platen are sometimes observed, rather than observing characteristics at the low-pressure nip between the PIP and the blanket, to maintain a working relationship in the printer.

When a new blanket is installed, an initial engagement at each nip is determined to ensure good print quality. The setup of the initial engagement is individual to each blanket to account for variations in production of the blanket and therefore different initial physical properties of each blanket, for example thickness and compressibility. During use of the blanket, the physical properties of the blanket change. The rate of change is individual to each blanket. For most blankets, a run-in period is performed to allow the blanket to settle to a more stable, longer-term physical state. During the run-in period, a blanket's properties change more quickly than in a subsequent longer-term period. Variations in the initial and dynamic physical properties of a blanket have a bearing on print quality.

In an example, the PIP rotates about an axis, and the transfer drum, having an installed blanket, rotates about a separate axis. These axes may be substantially parallel. The PIP and transfer drum can be engaged and disengaged by changing the inter-axial distance between the axes of the PIP and transfer drum. In some instances, movement of one of these axes toward or away from the other of these axes may take place to establish engagement or disengagement, respectively. In some printers, a "just-touch" calibration method is used to ensure adequate engagement when installing a blanket. The "just-touch" calibration method is performed using feedback to account for the initial physical properties of the blanket.

In the "just-touch" calibration method, a working point (WP) is established that achieves good print quality by observation of printing fluid coverage on the print media, for example. The WP changes during the working life of the printing device due to changes in blanket or print media conditions, for example. In some instances, the change in WP is detected by a change in pressure of engagement. When a nip of a printing device is operating at an engagement pressure which is too low, the nip can be said to be operating below the WP. When the nip of the printing device is operating at an engagement pressure which is too high, the nip can be said to be operating above the WP.

The WP may be a reference location or position of a rotation axis, such as the axis of the PIP or an axis of rotation of the platen. The reference location or reference position may be a coordinate. A movement of one of the axes to obtain a new WP may be expressed as a relative position, such as a displacement, i.e. a linear displacement or an angular displacement. The displacement may be an inter-axial displacement. That is, the displacement may be with respect to a distance between two axes. For example, a linear displacement of the axis of the PIP changes the inter-axial distance by the magnitude of the linear displacement.

A new WP is obtained when a predetermined value of pressure at a nip is reached. In obtaining the new WP, an axis of rotation is moved relative to another axis of rotation. The displacement is then the inter-axial distance between the old WP and the new WP. Displacement from a reference position may refer to inter-axial displacement of one axis with respect to another axis from a previous or initial position of the one axis. A plurality of displacements may be performed. The plurality of displacements may define a total displacement from the reference position including a first displacement from the reference position and a second displacement from the same reference position.

A starting WP is established for each of the first and second transfer operations. Initially, when a blanket is installed, the calibration to find the WP starts from a disengaged position, sometimes referred to as a "no contact" position. The inter-axial distance may be reduced until the PIP and blanket engage. The contact region forms a nip. In an engaged position, a developed image can be transferred from the PIP to the blanket. Once engaged, the inter-axial distance may be reduced further by increasing the contact or engagement force between the PIP and the transfer drum. At suitable increments of engagement, the printing fluid coverage is determined, for example, using the human eye or an electronic sensor such as a spectrophotometer, to assess whether to further increase or decrease the engagement force at the nip. The WP may be determined when a desired printing fluid coverage is achieved.

If the printing fluid coverage decreases after establishing the nip, the nip may be operating below a WP. This can occur when the inter-axial distance increases or the thickness of the blanket reduces during the blanket's working life because the engagement pressure may reduce. After successive print cycles and over a working life of the blanket, the dynamic physical changes may result in a drift away from the WP. Operating below the WP, the print quality suffers, for example, from low half-tone uniformity. In some instances, an adjustment of the inter-axial distance is needed to return to the correct WP.

At an impression side, between the image transfer member and the platen, drift from the WP is observed and adjustment is made during printing in some printers. In such printers, a servo motor is sometimes used to drive the platen and press the platen against the PIP. The servo motor is used to detect displacement and pressure so that adjustments can be made without requiring a calibration.

In some printers, a stepper motor is used to drive the PIP and the displacement and pressure is not monitored. Therefore, at a photoconductor side, between the PIP and the image transfer member, a drift from the WP may be detected when the print quality is less than desired. In response to undesirable print quality at the photoconductor side, a color calibration or a "just-touch" calibration may be performed. A color calibration comprises printing a reference job, measuring the print performance, and adjusting the relevant image development unit, also referred to as a Binary Ink Developer (BID), to alter the optical density (OD) outputted by the BID onto print media. A color calibration tends to lead to an increase in optical density because an increase in printing fluid quantity is transferred to the print media, which increases overall printing fluid consumption. Calibration means the printer is off-line during the calibration. Calibration also uses extra print media and printing fluid. Color calibrations may be periodically performed at a predetermined interval regardless of the print quality, such as an elapsed time or print cycle number.

FIG. 1 schematically illustrates a printing device 10. The printing device 10 may be a Digital Offset Color Printer. Digital Offset Color printing, sometimes also referred to as Liquid Electrophotography (LEP), is the process of printing in which liquid toner is applied onto a surface having a pattern of electrostatic charge (i.e. a latent image) to form a pattern of liquid toner corresponding with the electrostatic charge pattern (i.e. a developed image). This pattern of liquid toner is then transferred to at least one intermediate surface, such as a surface of a blanket of an image transfer medium, and then to a print medium. During the operation of a liquid electrophotographic system, developed images are formed on the surface of a PIP. These developed images are transferred to a blanket, that is heatable and may be provided around a cylinder, and then to a print media.

According to the example of FIG. 1, the printing device 10 comprises an image transfer member 120, a platen 130 to form a first nip 101 with the image transfer member 120, a PIP 110 to form a second nip 102 with the image transfer member 120 and a controller 140 to determine first information relating to a characteristic of the first nip 101, and to determine second information for use in adjusting a relative position of the PIP 110 and the image transfer member 120 on the basis of the first information.

In some examples, the first information and the second information each comprise a displacement. In some examples, the characteristic comprises a distance between the platen and the image transfer member. In some examples, the second information is a distance between the photo imaging plate and the image transfer member, such as an inter-axial distance, i.e. a distance between an axis of the photo imaging plate and an axis of the image transfer member.

Figure 2:
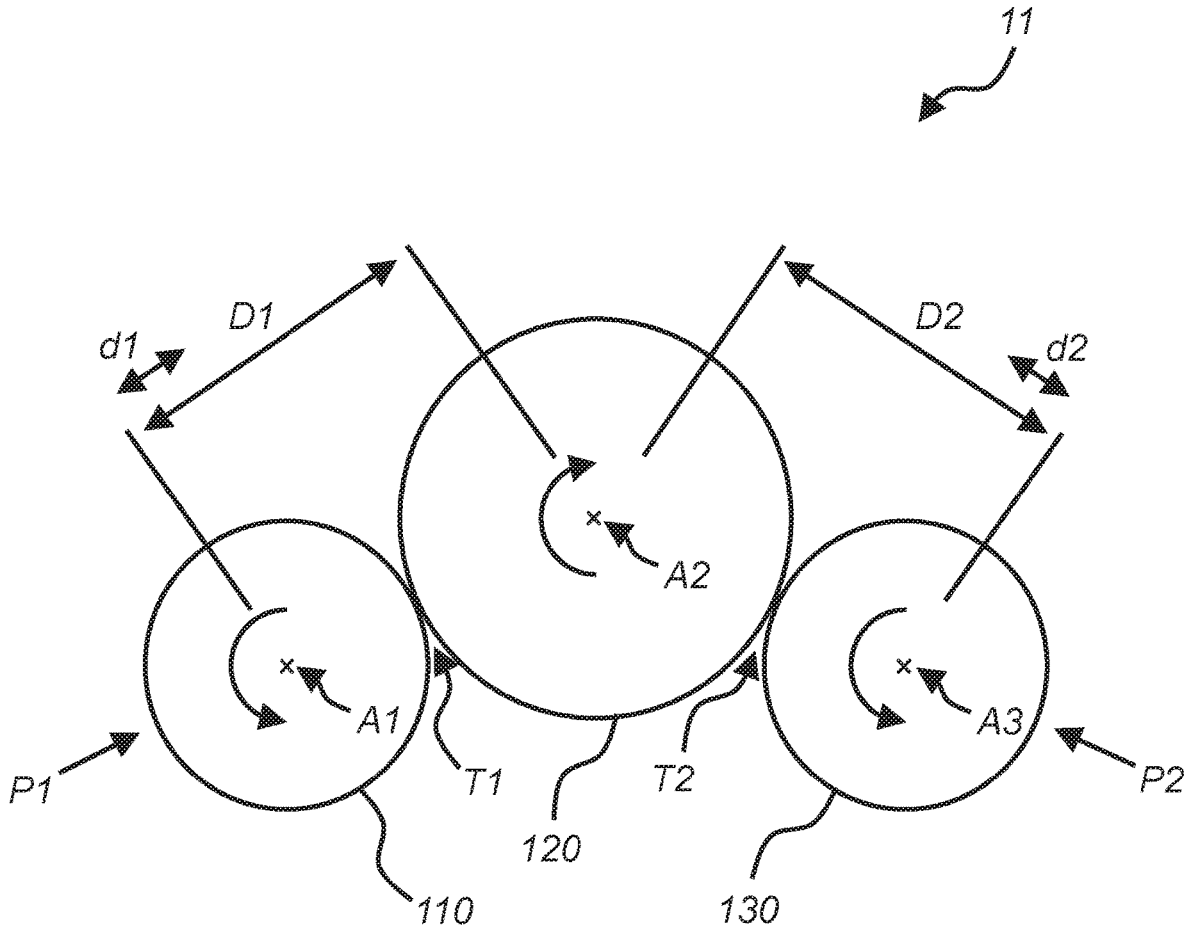
FIG. 2 is a schematic view of a printing device in accordance with an example.

FIG. 2 schematically illustrates a printing device 11 according to an example. The printing device 11 comprises a first element 130, such as a first roller, which may be a platen. The platen 130 is to rotate about an axis A3, for example, in an anti-clockwise direction, as shown. The printing device 11 further comprises an intermediate element, such as an image transfer roller 120. The image transfer roller 120 is to rotate about an axis A2, for example in a clockwise direction, as shown. The platen 130 and image transfer roller 120 together form an image transfer region at a first nip, which may be referred to as the "second transfer" T2. The inter-axial distance D2 between the axis A2 of the image transfer roller 120 and the axis A3 of the platen 130 may be varied by a second displacement d2. For example, a characteristic of the first nip, such as a pressure P2 of the second transfer T2, may be varied by changes in the second displacement d2. Alternatively, or additionally, a temperature associated with the second transfer T2 may be determined by a controller, similar to that of FIG. 1, wherein the temperature is an example of a characteristic of the first nip. The characteristic may be a distance between the platen and the image transfer member, for example an inter-axial distance.

In addition to the second transfer T2, a "first transfer" T1 is shown. The first transfer T1 is formed by a second element 110, such as a second roller, which may be a PIP. The PIP 110 is to rotate about an axis A1, for example, in an anti-clockwise direction, as shown. The PIP 110 and image transfer roller 120 together form an image transfer region at a second nip, which may be referred to as the "first transfer" T1. The inter-axial distance D1 between the axis A2 of the image transfer roller 120 and the axis A1 of the PIP 110 may be varied by a first displacement d1. For example, a characteristic of the second nip, such as a pressure P1 of the first transfer T1 may be varied by changes in the second displacement d1.

A controller (not shown), similar to that of FIG. 1, determines first information relating to a characteristic of the first nip. The first information may be a displacement, such as an inter-axial displacement. For example, when a pressure P2 of the second transfer T2 deviates from a predetermined value, the controller determines a change in the inter-axial distance D2 and causes adjustment of a relative position of the platen 130 and the image transfer member 120 by the second displacement d2 to return the pressure P2 of the second transfer T2 to the predetermined value. On the basis of the first information, such as the second displacement d2, the controller determines second information. The second information may be a displacement, such as an inter-axial displacement. The second information may be a displacement from a reference position, such as a displacement from an initial or former working point WP, or a displacement from a previous position. The position may refer to an axial position. The controller may determine the first displacement d1 to adjust a relative position of the PIP 110 and the image transfer member 120 by the first displacement d1. By reducing the inter-axial distance D1, a pressure P1 of the first transfer T1 is increased. The adjustment may comprise a plurality of adjustments. In contrast, by increasing the inter-axial distance D1, a pressure P1 of the first transfer T1 is reduced.

The controller may determine the second information, such as a first displacement d1, after the first information, such as the second displacement d2, is determined. The second information may be a function of the first information. For example, the first information may be used as a mathematical function to determine the second information. Instead of using the second information as a function, the first information may be used as a reference, for example, in a look-up table to obtain the second information.

Figure 3:
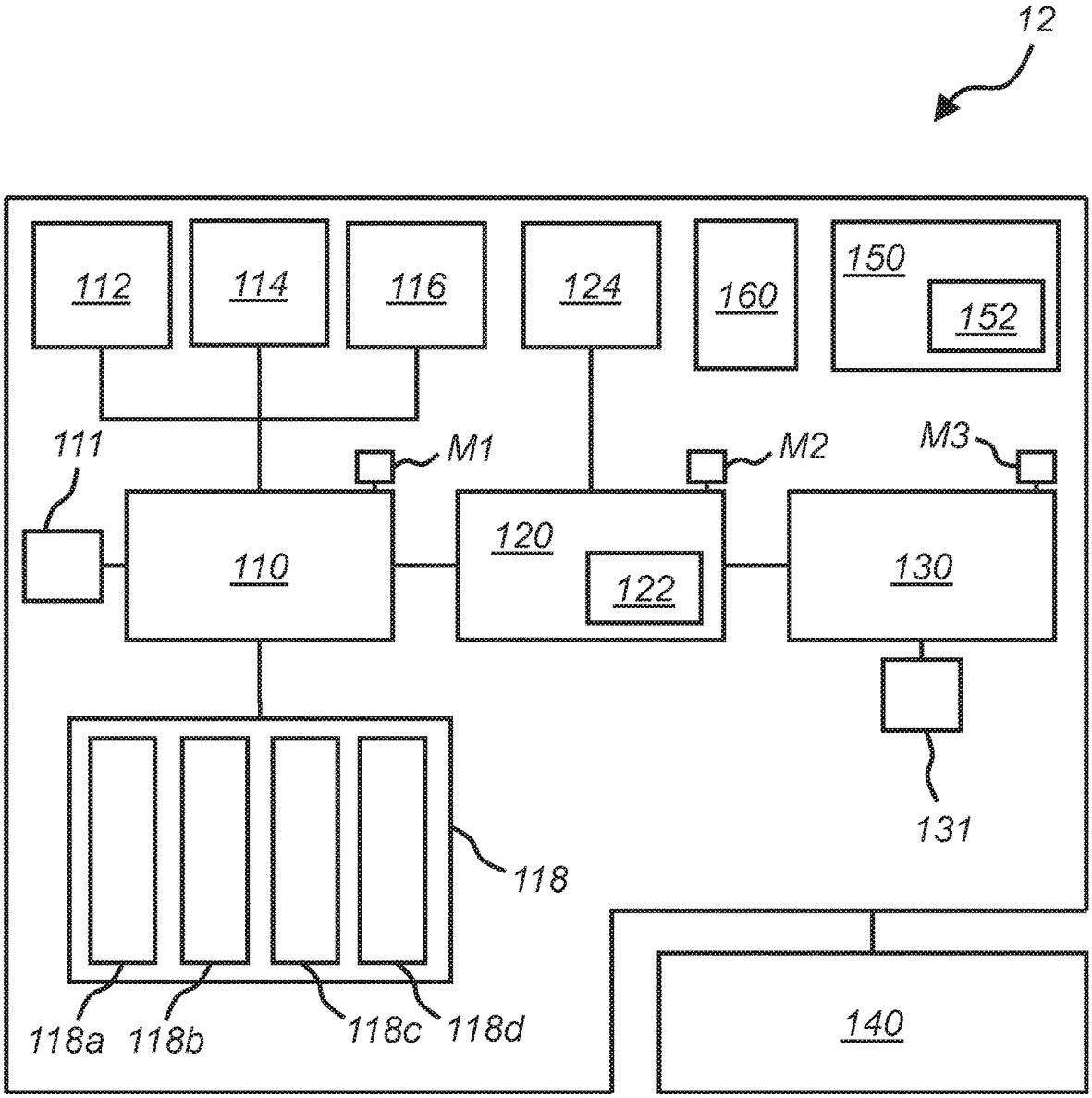
FIG. 3 is a schematic view of components of a printing device in accordance with an example.

FIG. 3 schematically illustrates components of a printing device 12. According to the example of FIG. 3, print media 152 of a print supply 150 is printed on by the printing device 12. Although the print supply 150 and the print media 152 are shown as part of the printing device 12, the print supply 150 and the print media 152 may be provided separately to the printing device 12.

The print media 152 comprises a substrate onto which printing fluid is printed. The substrate may be paper. The print media 152 may be continuous, for example when the print media 152 is provided in web form, or discrete, for example when the print media is provided in sheet form. The print media 152 may be fed on a per sheet basis, or from a roll sometimes referred to as a web substrate.

According to the example of FIG. 3, a latent image is formed on the PIP 110 by rotating a clean, bare segment of the PIP 110 under a photo charging unit 112. The PIP 110 in this example is cylindrical in shape, e.g. is constructed in the form of a drum, and rotates about the axis. The PIP 110 may be driven by a motor M1, such as a stepper motor. However, other types of motor may be used, for example a servo motor. The position of the PIP 110 can be accurately controlled by an adjuster 111. For example, the adjuster 111 can be commanded to move an axis of the PIP 110 relative to an axis of an image transfer medium 120 of the printing device 12 by a certain displacement or to a certain position by a controller 140 of the printing device 12 and hold the inter-axial position of the PIP 110.

In some examples, the adjuster is controllable by the controller 140 to adjust a relative position of the PIP 110 and the image transfer medium or member 120 on the basis of second information determined by the controller 140.

The photo charging unit 112 may include a charging device, such as corona wire, a charge roller, scorotron, or any other charging device. A uniform static charge may be deposited on the PIP 110 by the photo charging unit 112. As the PIP 110 rotates, it passes an imaging unit 114 where one or more laser beams may dissipate localised charge in selected portions of the PIP 110 to leave an invisible electrostatic charge pattern that corresponds to the image to be printed, i.e. a latent image. In some implementations, the photo charging unit 112 applies a negative charge to the surface of the PIP 110. In other implementations, the charge may be a positive charge. The imaging unit 114 may then locally discharge portions of the PIP 110, resulting in local neutralised regions on the PIP 110.

In example printing devices, printing fluid is transferred onto the PIP 110 by a developer unit 118, which comprises at least one image development unit 118*a*, 118*b*, 118*c*, 118*d*. An image development unit 118*a*, 118*b*, 118*c*, 118*d* may also be referred to as a Binary Ink Developer (BID). There may be one BID 118*a*, 118*b*, 118*c*, 118*d* for each printing fluid color, for example, cyan, magenta, yellow, black, orange, violet and green. In the example of FIG. 3, four BIDs 118*a*, 118*b*, 118*c*, 118*d* are shown. During printing, a developer roller within the appropriate BID 118 engages the PIP 110 to present a uniform film of printing fluid to the PIP 110. The printing fluid contains electrically-charged pigment particles which are attracted to the opposing charges on the image areas of the PIP 110. The printing fluid is repelled from the uncharged, non-image areas. The PIP 110 now has a single color image of printing fluid on its surface, i.e. a developed image.

The PIP 110 continues to rotate and transfers the developed image to the image transfer medium 120, which may comprise a blanket 122 that is heatable by a heater 124. The image transfer medium 120 may also be referred to an intermediate transfer member (ITM) and, when comprising a blanket 122, may be referred to as a blanket cylinder. The image transfer medium 120 rotates about the axis. The image transfer medium 120 may be driven by a motor M2, which may be a stepper motor or a servo motor, however other types of motor may be used. The transfer of a developed image from the PIP 110 to the image transfer medium 120 may be deemed the "first transfer". The PIP 110 passes a cleaning station 116, which may comprise a cleaner roller, which cleans the PIP 110 and removes unused printing fluid from the developer roller PIP 110.

Following the transfer of the developed image onto the rotating image transfer medium 120 in the first transfer, the printing fluid is heated by the heater 124. The heater 124 also heats the blanket 122 of the image transfer medium 120 when the image transfer medium 120 comprises a blanket 122. In certain implementations, the printing fluid may also be heated from an external heat source, which may include an air supply. This heating causes the printing fluid particles to partially melt and blend together. The printing fluid is then transferred from the image transfer medium 120 to the print media 152. This transfer from the image transfer medium 120 to the print media 152 may be deemed the "second transfer". In LEP printers employing a one-shot color process, the PIP 110 rotates several times, transferring a succession of developed images or separations and building them up on the image transfer medium 120 before they are transferred to the print media 152. Each separation may be a separate color developed image that can be layered on the image transfer medium 120. For example, there may be four layers, corresponding to the standard CMYK colors (cyan, magenta, yellow and black), that make up the final image which is transferred to the print media 152. In such examples, there may be four BIDs 118*a*, 118*b*, 118*c*, 118*d*. As the print media 152 contacts the image transfer medium 120, the final image is transferred to the print media 152.

During the second transfer, the image transfer medium 120 is pressed against a platen 130. Print media 152 is passed through the nip of the image transfer medium 120 and platen 130 so that the developed image can be transferred to the print media 152. The platen 120 may be an impression roller which is driven by a motor M3. The motor M3 is a servo motor, however other types of motor may be used, for example a stepper motor.

The position of the platen 130 can be accurately controlled by an adjuster 131. For example, the adjuster 131 can be commanded to move an axis of the platen 130 relative to the axis of the image transfer medium 120 by a certain displacement or to a certain position by the controller 140, and may be to hold the inter-axial position of the platen 130. The adjuster 131 is to apply pressure between an external surface of the platen 130 and an external surface of the image transfer medium 120. Any adjustment made by the adjuster 131, such as an inter-axial displacement made between the image transfer medium 120 and platen 130, is stored in a storage 160 of the printing device 12. In some examples, the adjustment may be stored elsewhere, such as external to the printing device 12.

During a print job, the inter-axial displacement between the image transfer medium 120 and the platen 130 may be controlled by the controller 140 and adjuster 131. A print job includes a printing event where a developed image is transferred to print media 152 and a non-printing event where print media is moved away from a printing zone between successive transfers of a developed image at the second transfer.

Figure 4:
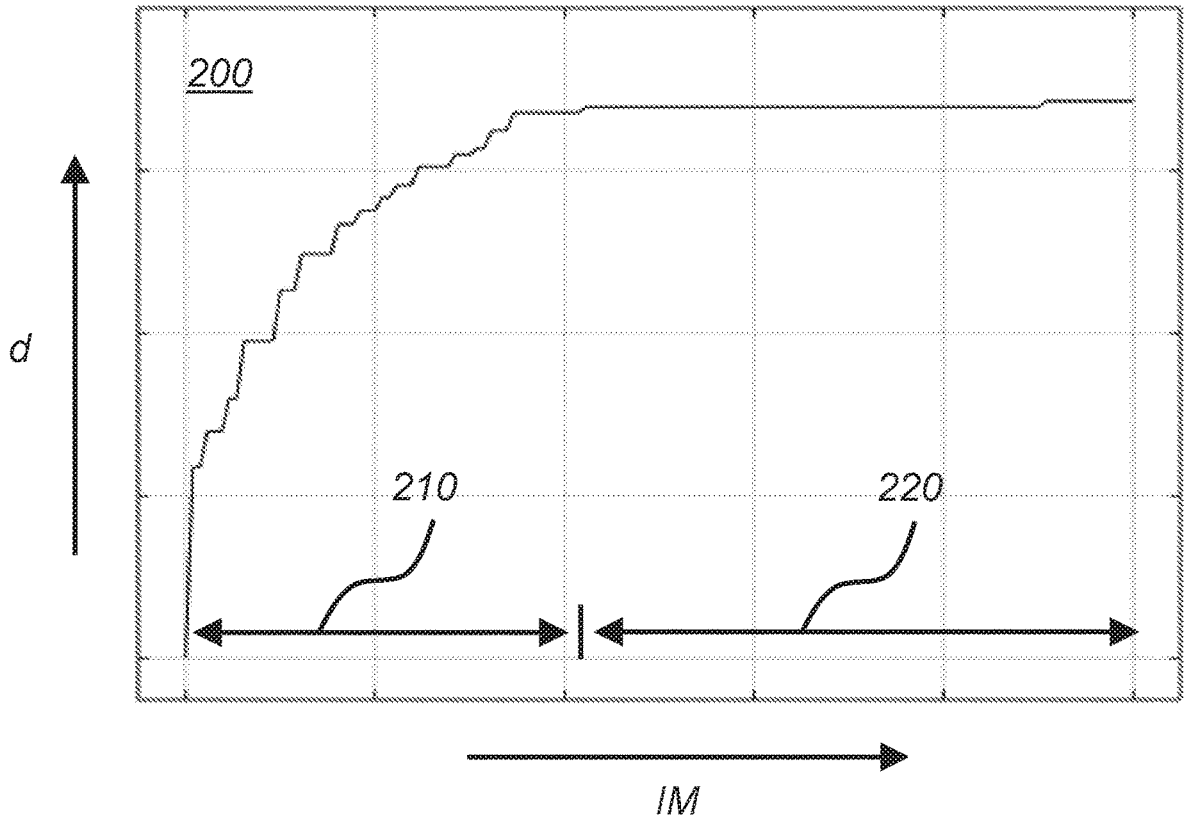
FIG. 4 is an example plot of data from a printing device in accordance with an example.

FIG. 4 is an example plot of data 200 from a printing device in accordance with an example. The data 200 comprises a displacement d and an impression count IM. The displacement d is a displacement from a working point WP which is set during initial calibration of the printing device, such as an inter-axial displacement between the image transfer medium and the platen that cooperate at the second transfer. For example, during determination by a controller that a pressure at a nip between the image transfer medium and the platen decreases, a displacement d may be made by an adjuster. On the basis of the displacement d at the nip between the image transfer medium and the platen, the controller may determine a displacement to be applied at another nip between the image transfer medium and the PIP. The adjustment at the other nip may be made con the fly', i.e. during a print job. The adjustment may further be made automatically without intervention by an operator of the printing device.

In FIG. 4, each displacement d is stored in a storage. The rate at which each displacement d is stored is based on an impression count IM. The impression count IM is the impression number at which the displacement was made from a starting number. An impression count IM may increment each time a developed image is transferred at the second transfer. In some examples, an impression count IM may increment on a specific angle of rotation of the image transfer medium 120 or of the platen 130, such as a full rotation.

The plot of data 200 in FIG. 4 shows an initial period 210 and a subsequent longer-term period 220. The initial period 210 shows a higher rate of change of displacement d with respect to impression count IM than the longer-term period 220. The rate of change in the initial period 210 may be dominated by a change in the print media as opposed to changes in the blanket. A thickness of a print media may therefore be determined based on the relative displacement d during the initial period 210. For example, the controller can determine a thickness of passed print media as a function of the stored displacement d. The function may be a rate of change of the displacement. The changes in displacement d in the longer-term period may be primarily due to changes in a physical property of the blanket.

Figure 5:
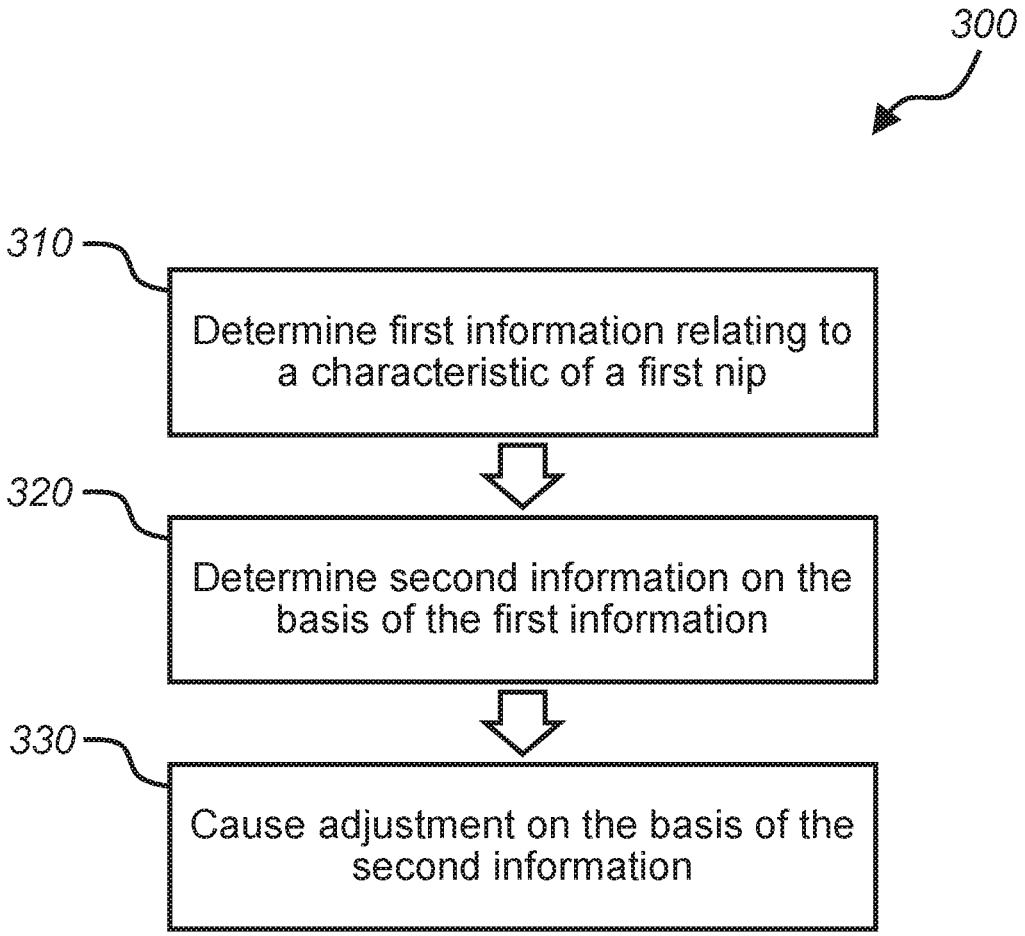
FIG. 5 is a flow diagram showing a method in accordance with an example.

FIG. 5 illustrates a flow diagram of a method 300. The method 300 can be performed by any one of the printing devices 10, 11, 12 discussed in relation to FIGS. 1 to 3. At block 310, the method 300 comprises determining first information relating to a characteristic of a first nip of a printing device, wherein the first nip is formed between a first roller and an image transfer roller. At block 320, the method 300 comprises determining second information on the basis of the first information, wherein the second information relates to a second nip between a second roller and the image transfer roller. At block 330, the method 300 comprises causing adjustment of a relative position of a rotation axis of the second roller and a rotation axis of the image transfer roller on the basis of the second information.

In some examples, block 310 may comprise determining a deviation of the characteristic from a predetermined value. In another block, the method may comprise causing adjustment of a relative position of a rotation axis of the first roller and the rotation axis of the image transfer roller to adjust the characteristic to the predetermined value.

In some examples, block 330 may comprise causing adjustment of the relative position by a plurality of adjustments.

In some examples, the method 300 may comprise passing print media through the first nip, storing the first information, and determining a thickness of a print media on the basis of the first information stored in the storage. The determining a thickness may comprise determining the thickness of the print media passed through the first nip as a function of the first information.

Certain system components and methods described herein may be implemented by way of non-transitory computer program code that is storable on a non-transitory storage medium. In some examples, the controller 140 may comprise a non-transitory computer readable storage medium comprising a set of computer-readable instructions stored thereon. The controller 140 may comprise at least one processor. Alternatively, at least one controller 140 may implement all or at least one part of the methods described herein.

Figure 6:
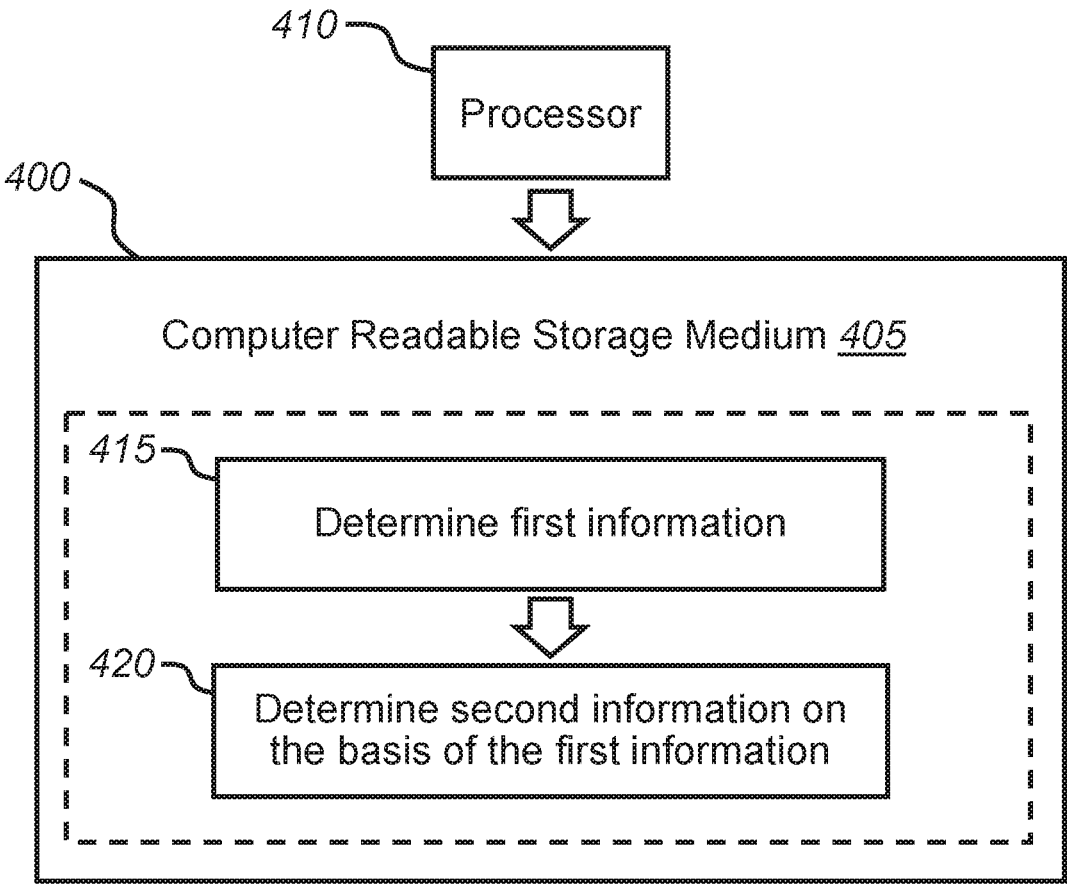
FIG. 6 is a schematic diagram showing an example set of computer readable instructions within a non-transitory computer-readable storage medium.

FIG. 6 shows an example of such a non-transitory computer readable storage medium 405 comprising a set of computer readable instructions 400 which, when executed by at least one processor 410, cause the at least one processor 410 to perform a method according to examples described herein. The computer readable instructions 400 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 400 cause the processor 410 in a printing device to, at block 415, determine first information relating to an image transfer region of the printing device between an intermediate element and a first element. At block 420, the instructions 400, cause the processor 410 to determine second information on the basis of the first information, wherein the second information relates to an additional image transfer region of the printing device between the intermediate element and a second element and wherein the second information is for use in adjusting a relative position of the second element and the intermediate element.

In another example, block 415 may comprise determining first information relating to a first nip of the printing device between a first roller and an image transfer roller. Block 420 then comprises determining second information on the basis of the first information, wherein the second information relates to a second nip of the printing device between a second roller and the image transfer roller and is for use in adjusting a relative position of the second roller and the image transfer roller.

In another example, block 415 may comprise determining first information relating to a first nip of the printing device between a platen and an image transfer member. Block 420 then comprises determining second information on the basis of the first information, wherein the second information relates to a second nip of the printing device between a photo imaging plate and the image transfer member and is for use in adjusting a relative position of the photo imaging plate and the image transfer member.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A printing device comprising:

an image transfer roller;

a first, platen roller to form a first nip with the image transfer roller;

a second, photo imaging roller to form a second nip with the image transfer roller; and a controller to:

determine first information relating to a characteristic of the first nip;

determine second information relating to the second nip on the basis of the first information; and cause adjustment of a relative position of a rotation axis of the second roller and a rotation axis of the image transfer roller on the basis of the second information.

2. The printing device of claim 1, wherein the characteristic comprises a distance between the first roller and the image transfer roller.

3. The printing device of claim 1, wherein the second information comprises a distance between the second roller and the image transfer roller.

4. The printing device of claim 1, wherein the printing device comprises:

an adjuster controllable by the controller to adjust a relative position of a rotation axis of the second roller and a rotation axis of the image transfer roller on the basis of the second information.

5. The printing device of claim 4, wherein the controller is to control the adjuster during a print job.

6. The printing device of claim 1, wherein the second information is a function of the first information.

7. The printing device of claim 1, wherein the characteristic comprises a pressure at the first nip.

8. The printing device of claim 1 comprising:

a storage to store the first information; and wherein the controller is to determine a thickness of a print media at the first nip on the basis of the first information stored in the storage.

9. The printing device of claim 8, wherein the thickness is a function of the first information stored in the storage.

10. A method comprising:

determining first information relating to a characteristic of a first nip of a printing device, wherein the first nip is formed between a first roller and an image transfer roller;

determining second information on the basis of the first information, wherein the second information relates to a second nip between a second roller and the image transfer roller; and causing adjustment of a relative position of a rotation axis of the second roller and a rotation axis of the image transfer roller on the basis of the second information.

11. The method of claim 10, wherein the determining first information comprises:

determining a deviation of the characteristic from a predetermined value.

12. The method of claim 11 comprising:

causing adjustment of a relative position of a rotation axis of the first roller and the rotation axis of the image transfer roller to adjust the characteristic to the predetermined value.

13. The method of claim 10 comprising:

passing a print media through the first nip;

storing the first information; and determining a thickness of the print media passed through the first nip on the basis of the first information.

14. The method of claim 13 wherein the determining a thickness comprises:

determining the thickness of the print media passed through the first nip as a function of the first information.

15. A non-transitory computer readable storage medium comprising a set of computer-readable instructions stored thereon, which, when executed by a processor, cause the processor to, in a printing device:

determine first information relating to a characteristic of a first nip of the printing device, wherein the first nip is formed between a first roller and an image transfer roller;

determine second information on the basis of the first information, wherein the second information relates to a second nip between a second roller and the image transfer roller; and cause adjustment of a relative position of a rotation axis of the second roller and a rotation axis of the image transfer roller on the basis of the second information.

* * * * *